US009241535B2

(12) United States Patent
Baudouin et al.

(10) Patent No.: US 9,241,535 B2
(45) Date of Patent: Jan. 26, 2016

(54) SOLE STRUCTURES AND ARTICLES INCORPORATING SAME

(71) Applicant: NIKE, Inc., Beaverton, OR (US)

(72) Inventors: Alexandre Baudouin, Portland, OR (US); John Hurd, Lake Oswego, OR (US); Robert M. Bruce, Portland, OR (US); Joshua P. Heard, Happy Valley, OR (US); Kevin W. Hoffer, Portland, OR (US); James Molyneux, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 302 days.

(21) Appl. No.: 13/830,758

(22) Filed: Mar. 14, 2013

(65) Prior Publication Data

US 2014/0259747 A1 Sep. 18, 2014

(51) Int. Cl.

| | |
|---|---|
| ***A43B 13/20*** | (2006.01) |
| ***A43B 13/18*** | (2006.01) |
| ***A43B 13/14*** | (2006.01) |

(52) U.S. Cl.

CPC ..... *A43B 13/181* (2013.01); *A43B 13/141* (2013.01); *A43B 13/183* (2013.01); *A43B 13/20* (2013.01)

(58) Field of Classification Search

CPC ..... A43B 13/00; A43B 13/14; A43B 13/141; A43B 13/20; A43B 13/181

USPC ..... 36/31, 102

See application file for complete search history.

(56) References Cited

U.S. PATENT DOCUMENTS

| | | | | |
|---|---|---|---|---|
| 43,469 | A | | 7/1864 | Bacon et al. |
| 1,220,061 | A | | 3/1917 | Baynard |
| 1,470,618 | A | | 10/1923 | Craine |
| 1,811,912 | A | | 6/1931 | White |
| 1,857,475 | A | | 5/1932 | Quirk |
| 2,135,676 | A | | 11/1938 | Roberts |
| 2,386,667 | A | | 10/1945 | Doherty |
| 2,393,990 | A | | 2/1946 | Kamborian |
| 2,478,664 | A | * | 8/1949 | Morrow et al. ..... 36/31 |
| 2,585,588 | A | | 2/1952 | Rice et al. |
| 3,081,774 | A | | 3/1963 | Lelyveld |
| 4,331,152 | A | | 5/1982 | Bartoli |
| 4,922,631 | A | | 5/1990 | Anderie |
| 5,311,680 | A | | 5/1994 | Comparetto |
| 5,481,814 | A | * | 1/1996 | Spencer ..... 36/138 |
| 5,561,920 | A | | 10/1996 | Graham et al. |

(Continued)

FOREIGN PATENT DOCUMENTS

| | | |
|---|---|---|
| EP | 0434076 | 12/1990 |
| FR | 2556569 | 6/1985 |
| WO | 03075698 | 9/2003 |

OTHER PUBLICATIONS

International Search Report and Written Opinion in PCT/US2014/028116 mailed Jul. 28, 2014.

*Primary Examiner* — Marie Bays

(74) *Attorney, Agent, or Firm* — Banner & Witcoff, Ltd.

(57) ABSTRACT

A sole structure may include at least one plate. The at least one plate may include a first portion located in a forefoot region of the sole structure and a second portion located in a rearfoot region of the sole structure. At least one compressible midsole component may be coupled to the at least one plate. A linkage rod couples the first and second portions and is configured to bias the first and second portions away from one another during bending of the sole structure.

20 Claims, 18 Drawing Sheets

(56) References Cited

U.S. PATENT DOCUMENTS

| | | | | |
|---|---|---|---|---|
| 6,138,385 | A * | 10/2000 | Jungkind et al. | 36/97 |
| 6,341,434 | B1 * | 1/2002 | Yeh | 36/132 |
| 6,345,455 | B1 | 2/2002 | Greer, Jr. et al. | |
| 6,742,288 | B2 | 6/2004 | Choi | |
| 6,745,499 | B2 | 6/2004 | Christensen et al. | |
| 7,143,529 | B2 | 12/2006 | Robinson, Jr. et al. | |
| 7,263,788 | B2 | 9/2007 | Johnson | |
| 7,503,132 | B2 | 3/2009 | Mason | |
| 7,549,239 | B2 | 6/2009 | Drollinger et al. | |
| 8,011,119 | B2 | 9/2011 | Tvoua et al. | |
| 8,505,220 | B2 * | 8/2013 | James et al. | 36/102 |
| 2003/0131501 | A1 * | 7/2003 | Erickson et al. | 36/127 |
| 2003/0131503 | A1 * | 7/2003 | Erickson et al. | 36/127 |
| 2005/0217148 | A1 | 10/2005 | Connolly et al. | |
| 2005/0268489 | A1 | 12/2005 | Austin | |
| 2006/0130361 | A1 * | 6/2006 | Robinson et al. | 36/25 R |
| 2007/0107264 | A1 * | 5/2007 | Meschter et al. | 36/76 R |
| 2007/0107265 | A1 * | 5/2007 | Mueller et al. | 36/91 |
| 2009/0056166 | A1 | 3/2009 | Edy et al. | |
| 2009/0113758 | A1 | 5/2009 | Nishiwaki et al. | |
| 2009/0183393 | A1 * | 7/2009 | Lee | 36/103 |
| 2010/0237599 | A1 | 9/2010 | Bianchi | |
| 2010/0275460 | A1 | 11/2010 | Ha | |
| 2011/0214313 | A1 * | 9/2011 | James et al. | 36/103 |
| 2011/0296713 | A1 | 12/2011 | Battaglino | |
| 2014/0165428 | A1 * | 6/2014 | Freschi | 36/102 |
| 2014/0259786 | A1 * | 9/2014 | Heard et al. | 36/103 |
| 2014/0366401 | A1 * | 12/2014 | Cavaliere et al. | 36/103 |

* cited by examiner

SOLE STRUCTURES AND ARTICLES INCORPORATING SAME

BACKGROUND

Conventional articles of athletic footwear often include an upper and a sole structure. The upper provides a covering for the foot that securely receives and positions the foot with respect to the sole structure. The sole structure is typically secured to a lower surface of the upper and positioned between the foot and the ground (or other contact surface) during wear of a shoe incorporating that upper and sole structure. The sole structure may include a midsole and an outsole. The midsole may help control foot motion and attenuate impact forces. For example, various midsoles may include elements formed from a foam material and/or include a fluid-filled bladder to help cushion a wearer foot. Although such elements provide many advantages, they may lack other qualities that may be desirable. For example, many conventional impact attenuation members lack "springiness," i.e., they lack a feel of bounce or recoil that can be beneficial in some activities. There remains a need for sole structures that include impact attenuation elements while also having other desirable properties.

SUMMARY

This Summary provides an introduction to some general concepts relating to this invention in a simplified form, which concepts and others are further described below in the Detailed Description. This Summary is not intended to identify key features or essential features of the invention.

In at least some embodiments, a sole structure may include at least one plate. The at least one plate may include a first portion located in a forefoot region of the sole structure and a second portion located in a rearfoot region of the sole structure. At least one compressible midsole component is coupled to the at least one plate. The at least one midsole may be coupled to a top of the at least one plate, to a bottom of the at least one plate, or to both. A linkage rod couples the first and second portions. The linkage rod is configured to bias the first and second portions away from one another during bending of the sole structure that moves the tops of the first and second portions toward one another.

Additional embodiments are described herein.

BRIEF DESCRIPTION OF THE DRAWINGS

The foregoing Summary, as well as the following Detailed Description, will be better understood when considered in conjunction with the accompanying drawings in which like reference numerals refer to the same or similar elements.

DETAILED DESCRIPTION

In at least some embodiments, a sole structure may include one or more propulsion linkage rods. Articles of footwear (e.g., shoes) incorporating such sole structures may be configured for wear during athletic activities such as walking, tennis, soccer, football, basketball, running, cross-training, golf, etc. Additional embodiments may include sole structures for footwear intended for other athletic or non-athletic activities, as well as footwear incorporating such sole structures.

Figure 1A:
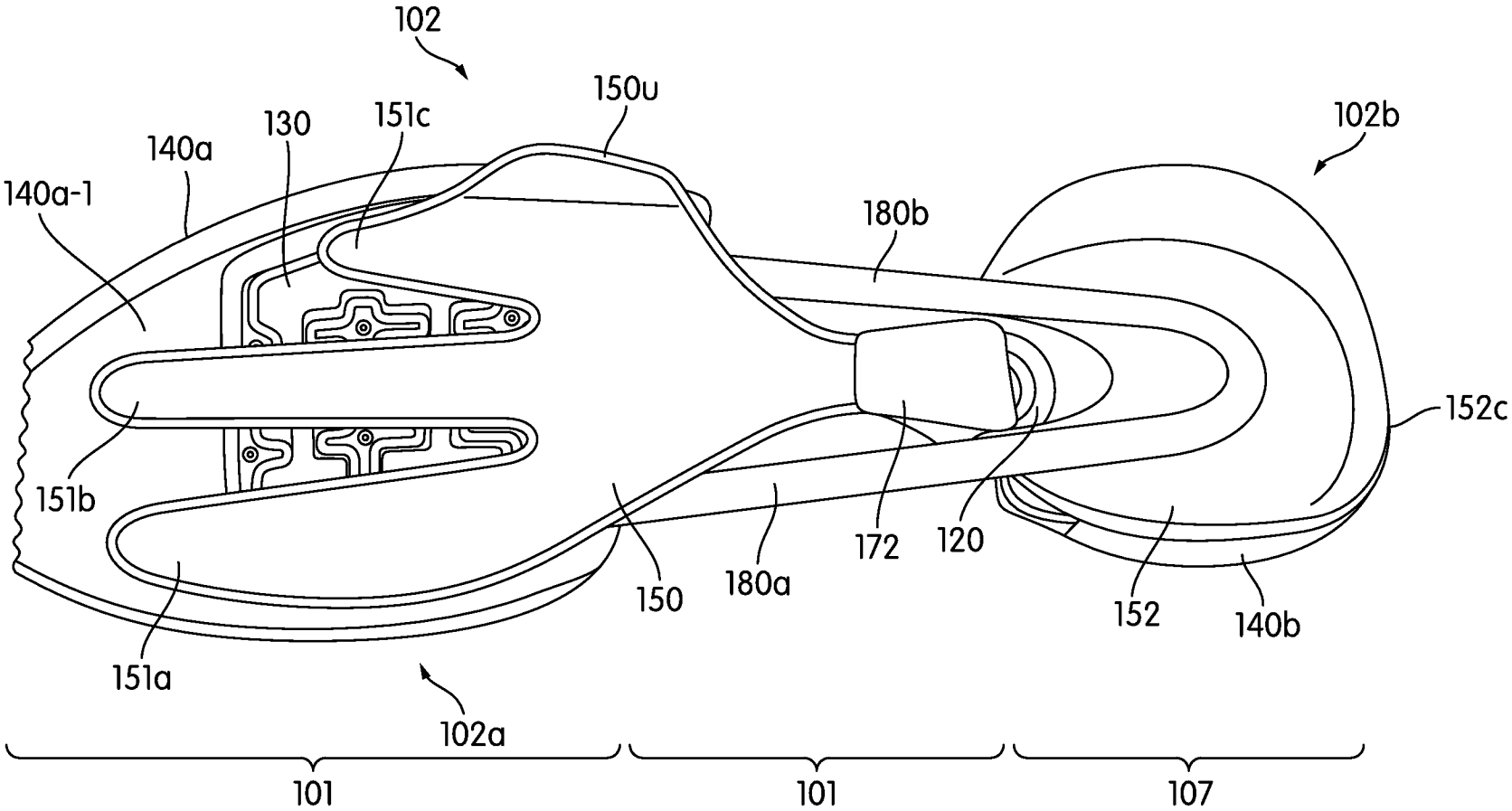
FIG. 1A is a top perspective view of a sole structure according to some embodiments.
Figure 1B:
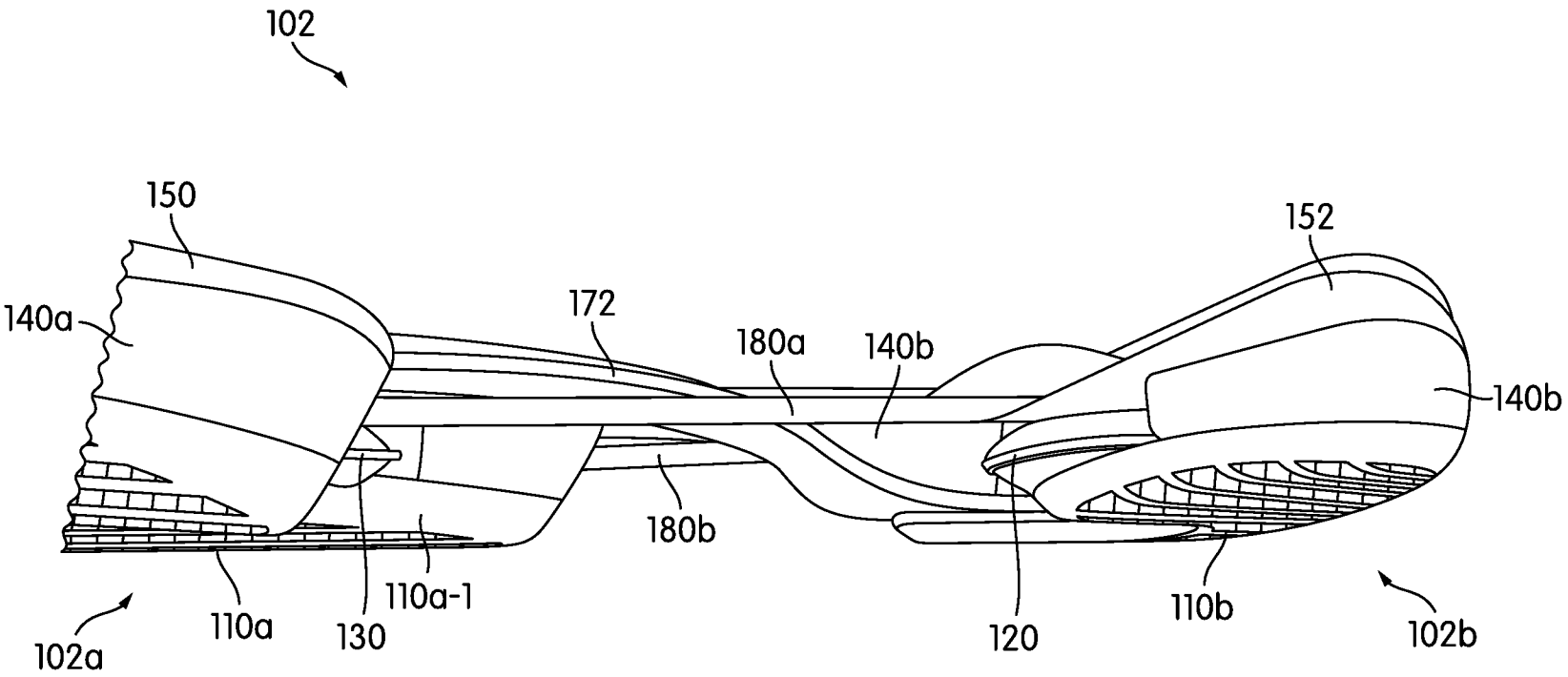
FIGS. 1B and 1C are respective side perspective and bottom views of the sole structure of FIG. 1A.
Figure 1C:
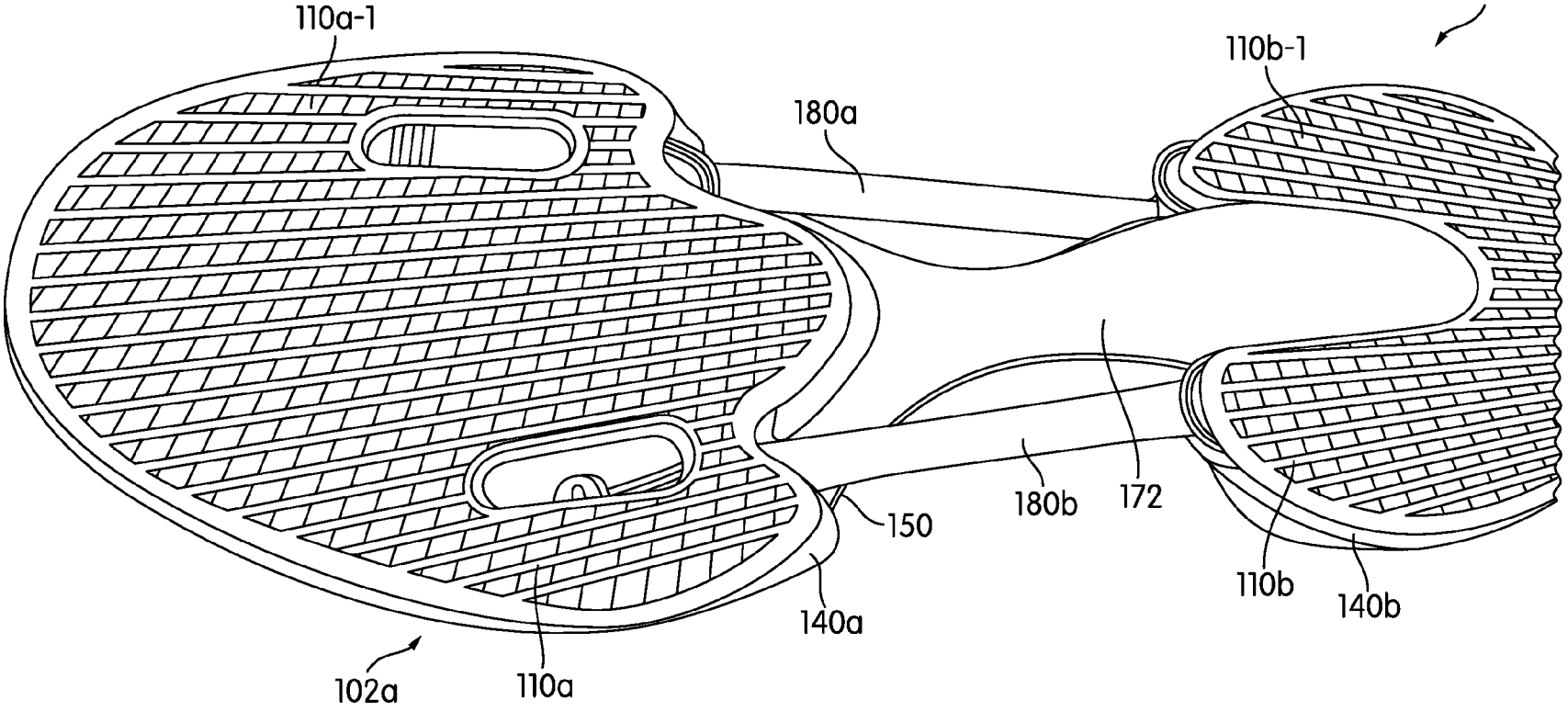

FIG. 1A is a top perspective view of a sole structure 102 according to some embodiments. FIG. 1B is a side view of sole structure 102. The forwardmost portion of sole structure 102 is omitted in FIG. 1B. FIG. 1C is a bottom view sole structure 102. The rearmost portion of sole structure 102 is omitted in FIG. 1C.

For reference purposes, sole structure 102 may be divided into three general regions as shown in FIG. 1A: a forefoot region 101, a midfoot region 103, and a heel or rearfoot region 107. Regions 101, 103 107 are not intended to demarcate precise areas of sole structure 102. Rather, regions 101, 103 and 107 are intended to represent general areas of sole structure 102 so as to provide a frame of reference for further discussion. Although not indicated in subsequent drawing figures, structures of other embodiments can similarly be generally divided into forefoot, midfoot and heel/rearfoot regions. Persons of ordinary skill will appreciate, in view of the disclosures herein, the general locations of such regions in other embodiments.

Sole structure 102 includes a forefoot outsole component 110*a*; a rearfoot outsole component 110*b*; a rearfoot fluid-filled bladder 120; a forefoot fluid-filled bladder 130; a forefoot midsole component 140*a*; a rearfoot midsole component 140*b*; a first plate 150 and a second plate 152. A forefoot portion 102*a* of sole structure 102 includes outsole component 110*a*, forefoot bladder 130 and a part of first plate 150. A rearfoot portion 102*b* of sole structure 102 includes rearfoot outsole component 110*b*, rearfoot bladder 120 and rearfoot midsole component 140*b*. Forefoot portion 102*a* and rearfoot portion 102*b* are connected by linkage rods 180*a* (medial) and 180*b* (lateral) and by an extension 172 of first plate 150.

Sole structure 102 can be incorporated into a shoe having an upper of any desired construction. In the embodiment of sole structure 102, there are separate forefoot and rearfoot outsole components and separate forefoot and rearfoot midsole components. In other embodiments, a unitary midsole structure may have portions in forefoot, midfoot and/or rearfoot regions, and/or a unitary outsole structure may have portions in forefoot, midfoot and/or rearfoot regions.

As shown in FIG. 1C, outsole components 110*a* and 110*b* include respective bottom surfaces 110*a*-1 and 110*b*-1. Outsole components 110*a* and 110*b* further include respective top surfaces that face bottom surfaces of midsole components 140*a* and 140*b*, respectively. Outsole components 110*a* and 110*b* may be formed from, e.g., synthetic rubber. The top surface of outsole 110*a* may include recessed areas, raised rims and/or other surface features to help contain and/or secure bladder 130 and midsole component 140*a*. The top surface of outsole 110*b* may include recessed areas, raised rims and/or other surface features to help contain and/or secure bladder 120 midsole component 140*b*.

Bottom surfaces of midsole components 140*a* and 140*b* are bonded or otherwise attached to interior surfaces 110*a*-2 and 110*b*-2, respectively. Midsole components 140*a* and 140*b* may be formed from one or more types of polymer foam material (e.g., polyurethane foams, ethylene vinyl acetate (EVA) foams, phylon, phylite, etc.). Forefoot midsole component 140*a* includes a region 140*a*-1 that defines a pocket for receiving and holding bladder 130. Similarly, rearfoot midsole component 140*b* includes a rearfoot region that defines a pocket for receiving and holding bladder 120. Bladder 130 may be adhesively bonded to forefoot midsole component 140*a* and/or to the underside of first plate 150. Bladder 120 may be adhesively bonded to rearfoot midsole component 140*b* and/or to the underside of second plate 152. Bladder 120 may also rest on top of (and may be bonded to) the rearmost portion of extension 172 of first plate 150. Bladders 120 and 130 may be made in any desired manner and/or from any desired materials, including in manners and/or using materials conventionally utilized to form fluid-filled bladders for footwear sole structures.

First plate 150 includes a front portion that extends from forefoot region 101 and into midfoot region 103. First plate 150 further includes an extension 172 that extends through midfoot region 103 and into rearfoot region 107. As shown in FIGS. 1A and 1B, the front portion of first plate 150 is located over portions of forefoot midsole component 140*a* and forefoot bladder 130 and at least partially covers bladder 130. Extension 172 curves downward and extends below a bottom surface of rearfoot bladder 120.

First plate 150 includes a lateral side plantar support element 151*c*, a central plantar support element 151*b* and a medial side plantar support element 151*a*. Elements 151*c* and 151*b* are separated by a first gap. Elements 151*b* and 151*a* are separated by a second gap. Lateral side plantar support element 151*c* supports an outside of a foot during a hard turn or cutting action. Central plantar support element 151*b* supports the third metatarsal region of a wearer foot. Medial side plantar support element 151*a* supports the hallux or big toe area of a wearer foot. The gaps between the support elements 151*a*-151*c* partially decouples and separates each of a first metatarsal support region, a third metatarsal region, and a fifth metatarsal region of first plate 150. Plantar support elements 151*a*-151*c* promote lateral-to-medial flex and help permit a more natural motion (e.g., to allow the sides of a wearer foot to more easily flex with respect to one another as the wearer's weight transfers from the outside to the inside during a step cycle). The lateral side of first plate 150 includes an upward extension 150U in the fifth metatarsal area (little toe area). Upward extension 150U resists lateral movement of the foot with respect to the sole structure 102 during a hard turn or cutting action. The top surface of the front portion of first plate 150, and the top surfaces of other components in forefoot portion 102*a*, may be curved, arched, and/or otherwise contoured so as to comfortably support a wearer's foot.

The bottom surface of first plate 150 may be bonded to the top surface of forefoot bladder 130 and to parts of region 140*a*-1 of forefoot midsole component 140*a*. The rearmost end of extension 172 may be bonded to the top surface of rearfoot outsole component 110*b* and/or to the bottom surface of rearfoot bladder 120. When sole structure 102 is incorporated into a shoe, the top surface of the front portion of first plate 150 may be bonded to a Strobel or other lasting element of an upper of that shoe.

Second plate 152 is located over, and rests on, rearfoot bladder 120 and portions of rearfoot midsole component 140*b*. The underside of second plate 152 is attached to rear ends of linkage rods 180*a* and 180*b*. In some embodiments, the rear ends of linkage rods 180*a* and 180*b* may be attached to the top surface of second plate 152. In some such embodiments, an additional midsole component may be placed between the top surface of second plate 152 and an upper of a shoe incorporating sole structure 102.

The top surface of second plate 152 is concave, with an outer edge of second plate 152 forming a heel cup 152C. Heel sup 152C resists lateral, medial and/or rearward movement of a wearer foot when making hard cuts and turns. The bottom surface of second plate 152 is bonded to bladder 120 and to portions of rearfoot midsole component 140*b*.

In the embodiment of sole structure 102, each of first plate 150 and second plate 152 is a single, integral structure. That may be molded or otherwise formed from one or more polymers (e.g., TPU), from a composite (e.g., carbon and/or glass fibers bound in an polymer matrix), or from other materials. The material of plates 150 and 152 may be substantially incompressible. For example, and as compared to midsole components 140*a* and/or 140*b*, plates 150 and 152 do not compress in response to finger pressure or in response to forces normally imposed by a shoe wearer.

The presence of separate first and second plates 150 and 152 enhances flexibility of sole structure 102 and partially decouples forefoot and rearfoot regions of sole structure 102 about a longitudinal (rearfoot to forefoot) twist axis. This decoupling can improve the overall comfort and feel of the shoe as the wearer takes a step (and weight shifts from the heel to the forefoot) and provide a more natural motion and feel.

Linkage rods 180*a* and 180*b* extend into forefoot region 101. The forward end of medial side linkage rod 180*a* extends under and is attached to the medial side first plate 150. The forward end of lateral side linkage rod 180*b* extends under and is attached to the lateral side of the first plate 150. In some embodiments, linkage rods 180*a* and 180*b* are part of the same U-shaped piece, with the base of that "U" attached to the bottom or top of second plate 152. In the embodiment of sole structure 102, linkage rods 180*a* and 180*b* have oval-shaped cross-sections. Linkage rods in other embodiments may have other cross-sections (e.g., rectangular, square, circular, etc.).

In at least some embodiments, linkage rods 180*a* and 180*b* are formed from a carbon fiber composite (e.g., carbon bound in an epoxy resin) so as to be flexible and provide a noticeable amount of recoil during walking or running. In particular, linkage rods 180*a* and 180*b* help provide rebound energy and a propulsive feel to sole structure 102. Rods 180*a* and 180*b* store energy as they are bent during dorsiflexion of the wearer foot. In dorsiflexion, which can occur when the shoe wearer's body moves over the foot while walking or running, sole structure 102 bends so as to generally move a forefoot region portion of the top of first plate 150 toward the top of second plate 152. As a result, rods 180*a* and 180*b* bias first plate 150 and second plate 152 back to their unbent state. As the wearer foot plantar flexes (e.g., as the wearer pushes off with that foot), the stored energy is released and returned to the wearer foot. Including linkage rods may thus help ameliorate the lack of "springiness" or "bounce" that can sometimes be associated with fluid filled bladders and other impact absorbing elements of a sole structure.

Figure 2A:
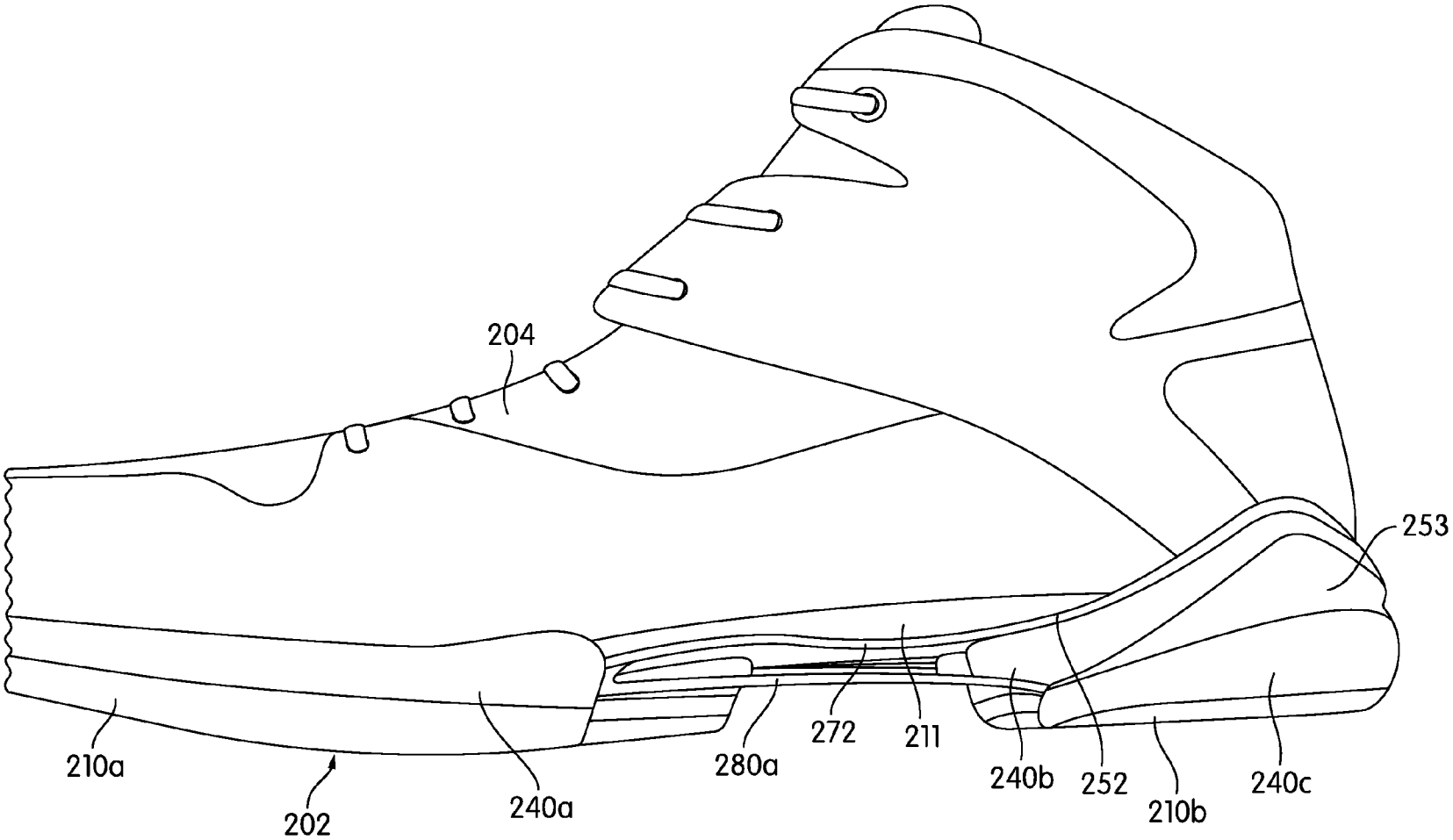
FIG. 2A is a side view of a shoe incorporating a sole structure according to some additional embodiments.
Figure 2B:
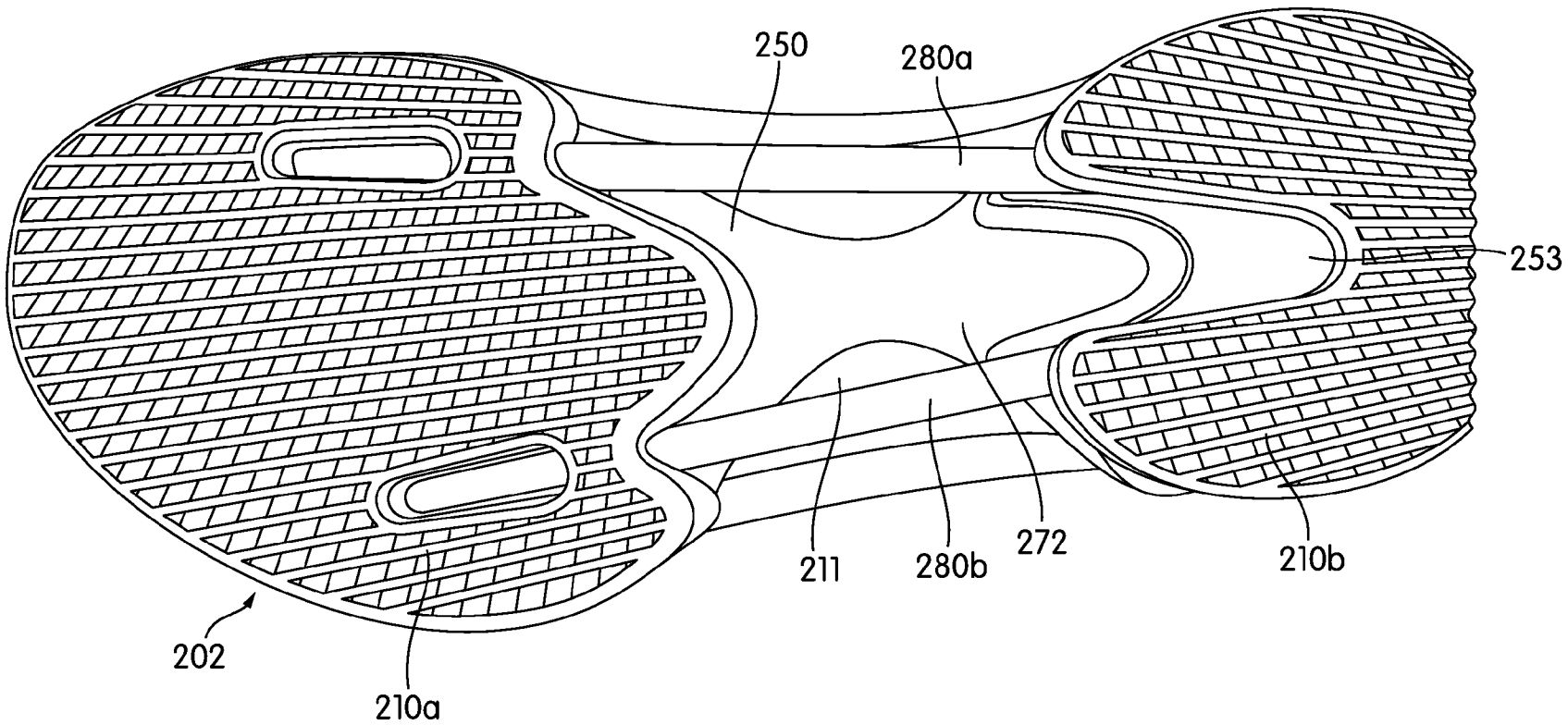
FIGS. 2B and 2C are respective bottom and bottom perspective views of the sole structure of FIG. 2A.
Figure 2C:
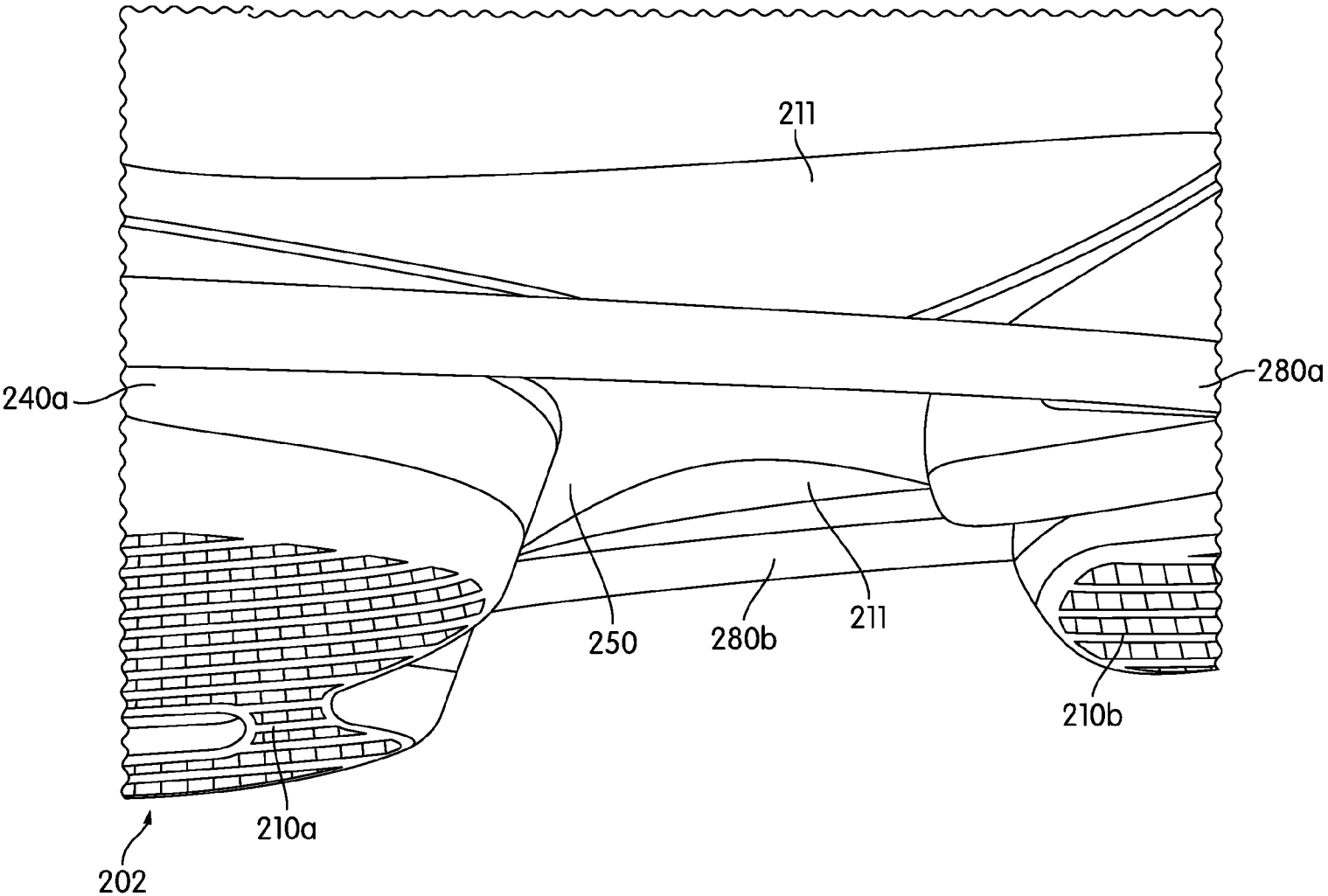

FIG. 2A is a medial side view of a shoe incorporating a sole structure 202 according to another embodiment. The shoe of FIG. 2A includes an upper 204. The toe portion of the shoe is not shown in FIG. 2A. FIG. 2B is a bottom view of sole structure 202, with the rearmost portion of sole structure 202 not shown. FIG. 2C is an enlarged bottom medial side perspective view of a portion of sole structure 202 and of upper 204. In FIGS. 2A through 2C, a portion of a Strobel 211 of upper 204 is visible. In some embodiments, Strobel 211 is not exposed. Instead, regions of Strobel 211 not bonded to sole structure 202 (as well as adjoining regions of upper 204 beyond Strobel 211) may be covered by a layer of TPU, phylon or other material.

Sole structure 202 could alternatively be incorporated into a shoe having a different type of upper. Indeed, sole structure 202 and sole structures according to other embodiments described herein could be incorporated into footwear having any type of upper.

Sole structure 202 is similar to sole structure 102. For example, sole structure 202 includes a first plate 250, a forefoot outsole component 210*a*, a forefoot midsole component 240*a*, a forefoot bladder (not visible in FIGS. 2A-2C), a second plate 252, a rearfoot outsole component 210*b*, a rearfoot midsole component 240*b*, a rearfoot bladder (also not visible in FIGS. 2A-2C), and linkage rods 280*a* and 280*b*. However, an extension 272 of first plate 250 generally does not curve downward to the same extent as extension 172 of first plate 150. Instead, extension 272 joins second plate 252, with the top surfaces of first plate 250 (including extension 272) and second plate 252 contacting and bonded to Strobel 211. Sole structure 202 also includes a third plate 253 in the rearfoot region and a second rearfoot midsole element 240*c*. Linkage rods 280*a* and 280*b* are attached to a bottom surface of third plate 253. The top of rearfoot midsole element 240*c* is bonded to the bottom of third plate 253 and the bottom of rearfoot midsole element 240*c* is bonded to the top of outsole component 210*b*. The bottom of rearfoot midsole component 240*b* is bonded to the top of third plate 253 and the top of rearfoot midsole component 240*b* is bonded to the bottom of second plate 252. The rearfoot bladder is contained within rearfoot midsole component 240*b* in some embodiments. In other embodiments, the rearfoot bladder in contained within rearfoot midsole component 240*c*.

Figure 3A:
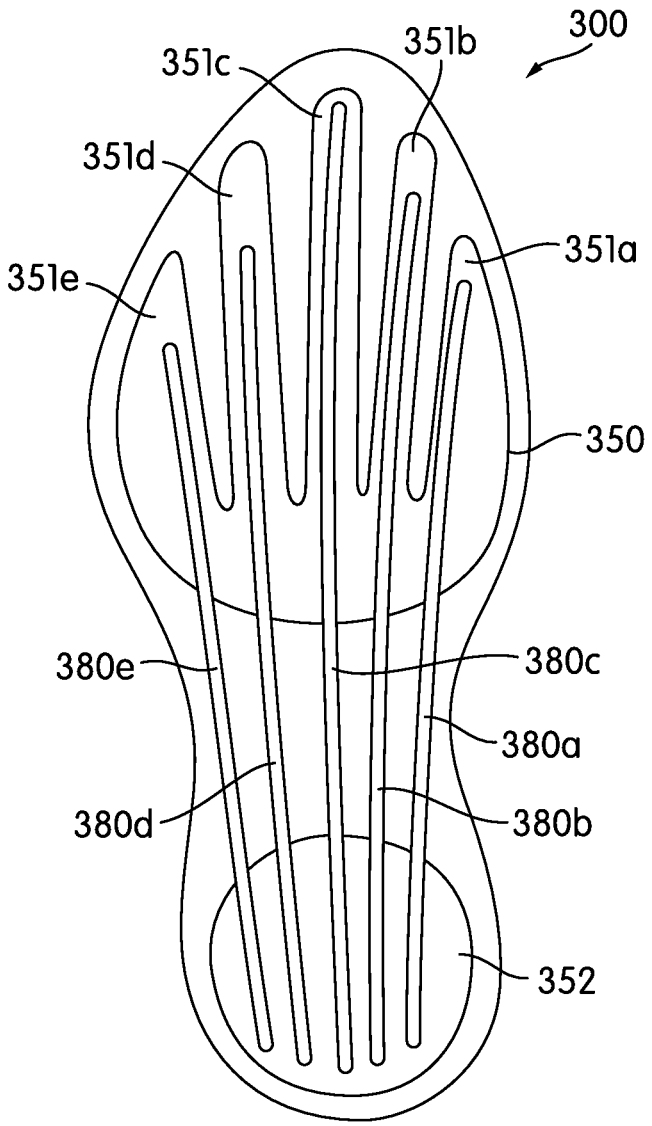
FIGS. 3A and 3B are respective top and side views of a plate and rod structure according to some additional embodiments.
Figure 3B:
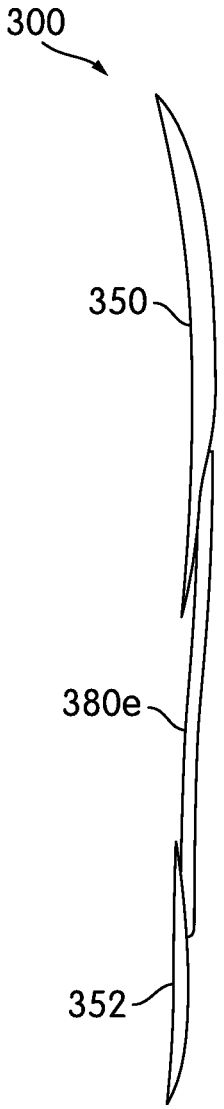

FIGS. 3A and 3B are respective bottom and side views of a plate and rod structure 300 according to another embodiment. Plate and rod structure 300 may be incorporated into a sole structure. Structure 300 includes a first plate 350 in a forefoot region and a second plate 352 in a rearfoot region. Forward ends of linkage rods 380*a*-380*e* are respectively attached to the bottoms of plantar support elements 351*a*-351*e* of first plate 350. The forward ends of rods 380*a*-380*e* and plantar supports 351*a*-351 correspond to metatarsal regions of a wearer of a shoe that includes structure 300. The rear ends of linkage rods 380*a*-380*e* are attached to the bottom of second plate 352.

The top surfaces of first plate 350 and second plate 352 may be curved, arched, and/or otherwise contoured so as to comfortably support a wearer's foot. One or more edges of plate 352 may form a heel cup. One or more edges of plate 350 may form a lateral or medial side support.

Structure 300 may be incorporated into a sole structure, in at least some embodiments, by attaching forefoot bladder, midsole and outsole components to the bottom of first plate 350 and by attaching rearfoot bladder, midsole and outsole components to the bottom of second plate 352. Alternatively, a midsole component and/or a bladder may be attached to the top of first plate 350 and/or to the top of second plate 352. A sole structure incorporating structure 300 may then be attached to an upper.

Figure 4:
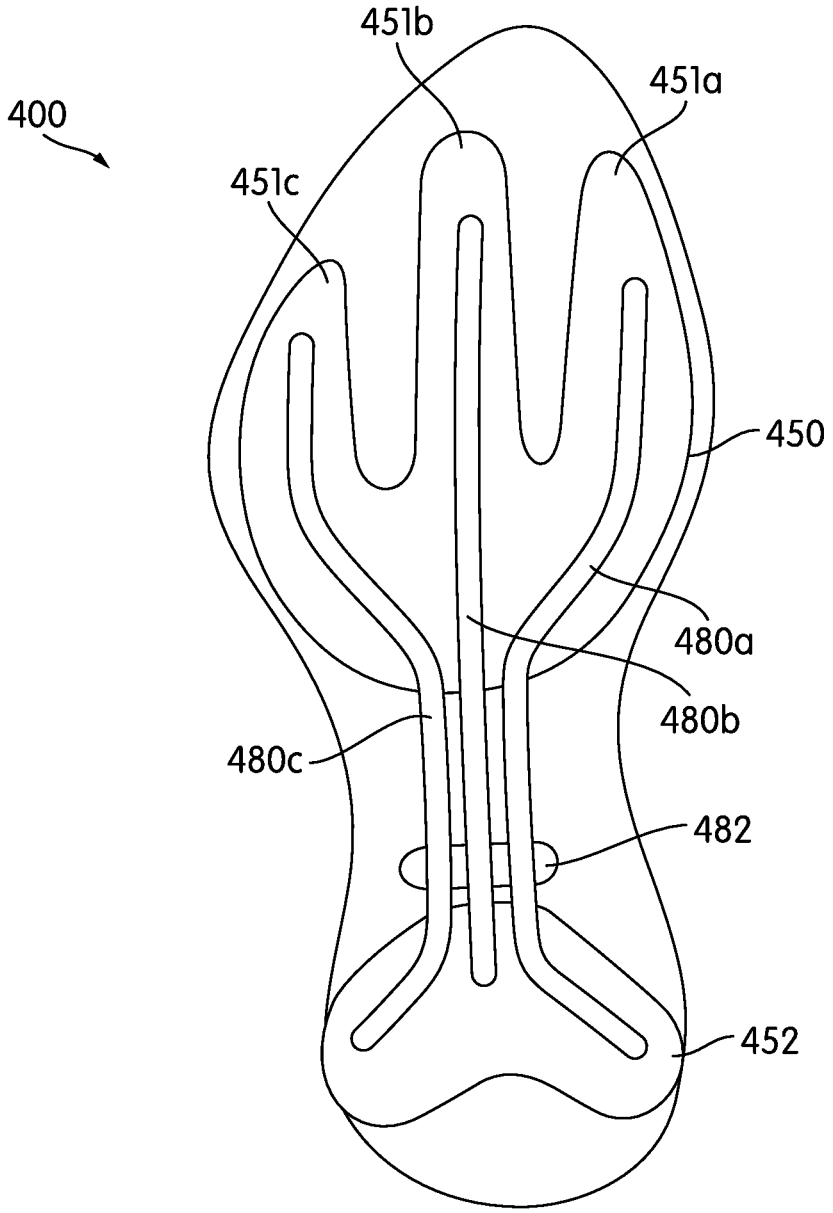
FIGS. 4 through 7 show plate and rod structures according to various additional embodiments.

FIG. 4 is a bottom view of a plate and rod structure 400 according to another embodiment. Plate and rod structure 400 may be incorporated into a sole structure. Structure 400 includes a first plate 450 in a forefoot region and a second plate 452 in a rearfoot region. Forward ends of linkage rods 480*a*, 480*b* and 480*c* are respectively attached to the bottoms of medial plantar support element 451*a*, center plantar support element 451*b* and lateral plantar support element 451*c*. The forward ends of rods 480*a*-480*e* and plantar supports 451*a*-451 respectively correspond to first, third and fifth metatarsal regions of a wearer of a shoe that includes structure 400. The rear ends of linkage rods 480*a*-480*c* are attached to the bottom of second plate 452. An adjustable slider 482 is movable along a portion of the lengths of rods 480*a*-480*c* so as to adjust the degree of spring and twist afforded by rods 480*a*-480*c*. An opening can be included on the medial or lateral side of a sole structure incorporating structure 400 that permits a user to access slider 482. Slider 482 can be provided with a detent mechanism, e.g. ball and spring-type mechanism, clamp, or friction lock to provide a locking engagement in place on the footwear.

The top surfaces of first plate 450 and second plate 452 may be curved, arched, and/or otherwise contoured so as to comfortably support a wearer's foot. One or more edges of plate 452 may form a heel cup. One or more edges of plate 450 may form a lateral or medial side support. Structure 400 may be incorporated into a sole structure, in at least some embodiments, by attaching forefoot bladder, midsole and outsole components to the bottom of first plate 450 and by attaching rearfoot bladder, midsole and outsole components to the bottom of second plate 452. Alternatively, a midsole component and/or a bladder may be attached to the top of first plate 450 and/or to the top of second plate 452. A sole structure incorporating structure 400 may then be attached to an upper.

Figure 5:
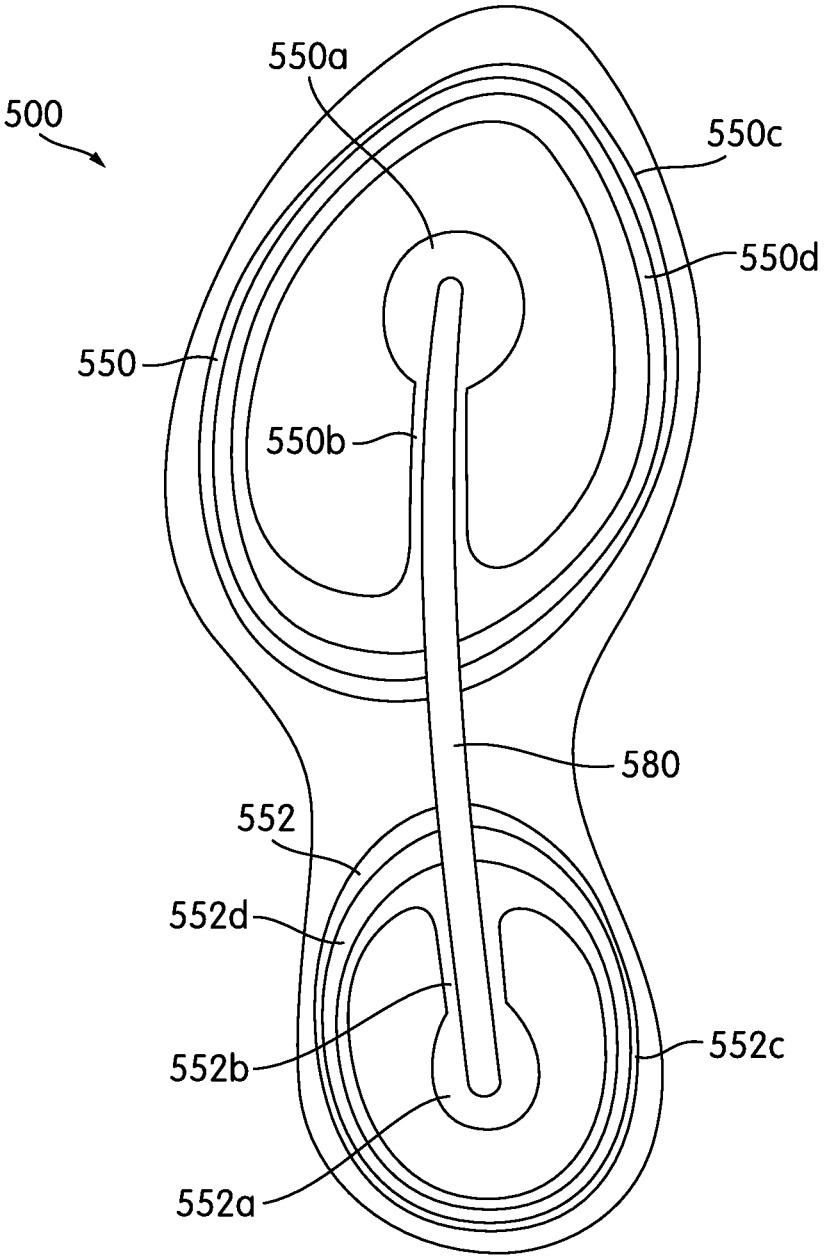

FIG. 5 is a bottom view of a plate and rod structure 500 according to another embodiment. Plate and rod structure 500 may be incorporated into a sole structure. Structure 500 includes a first plate 550 in a forefoot region and a second plate 552 in a rearfoot region. Each of plates 550 and 552 is generally ring shaped and has an internal open area. A single linkage rod 580 connects first plate 550 to second plate 552.

First plate 550 includes a concentric portion 550*a*, a radially extending portion 550*b* and an outer rim portion 550*c*. A reinforcement rim 550*d* is integral to rod 580 and attached to the bottom of rim portion 550*c*. Second plate 552 includes a concentric portion 552*a*, a radially extending portion 552*b* and an outer rim portion 552*c*. A reinforcement rim 552*d* is also integral to rod 580 and is attached to the bottom of rim portion 552*c*. Linkage rod 580 extends from forefoot concentric portion 550*a* to rearfoot concentric portion 552*a*.

The top surfaces of first plate 550 and second plate 552 may be curved, arched, and/or otherwise contoured so as to comfortably support a wearer's foot. One or more edges of plate 552 may form a heel cup. One or more edges of plate 550 may form a lateral or medial side support. Structure 500 may be incorporated into a sole structure, in at least some embodiments, by attaching forefoot bladder, midsole and outsole components to the bottom of first plate 550 and by attaching rearfoot bladder, midsole and outsole components to the bottom of second plate 552. Alternatively, a midsole component and/or a bladder may be attached to the top of first plate 550 and/or to the top of second plate 552. A sole structure incorporating structure 500 may then be attached to an upper.

Figure 6:
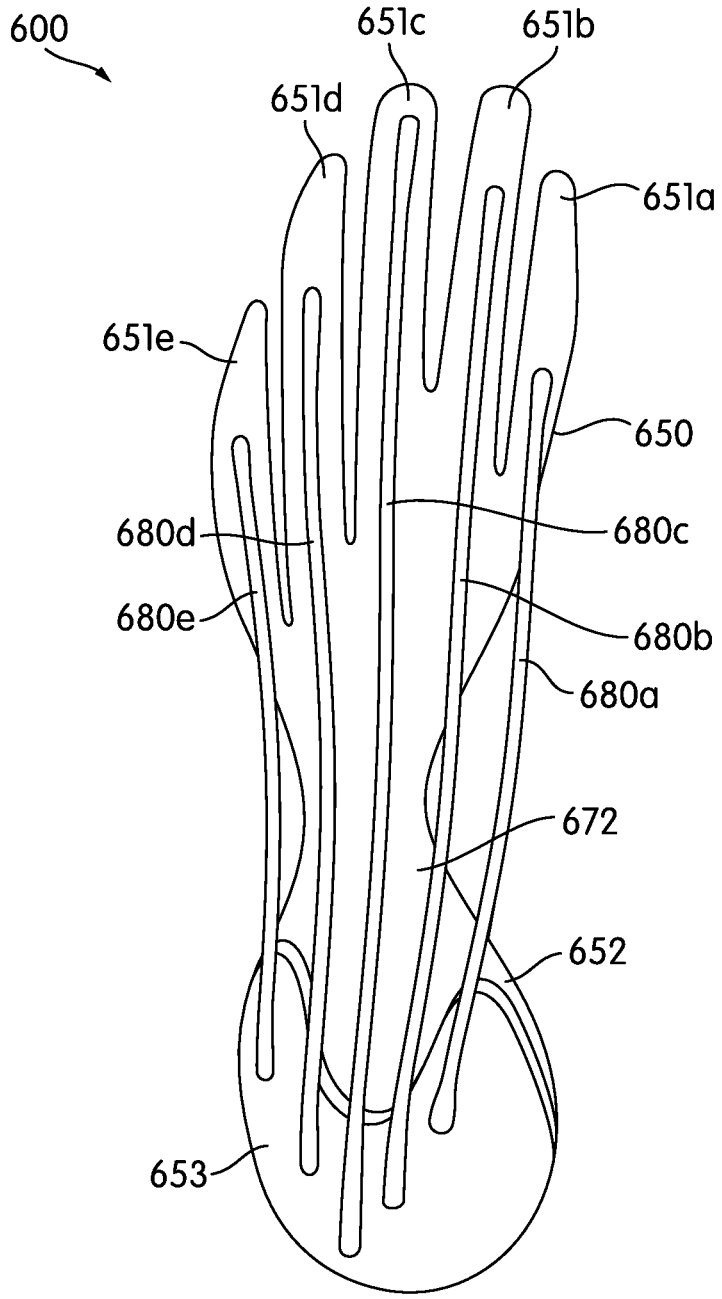

FIG. 6 is a bottom side perspective view of a plate and rod structure 600 according to another embodiment. Plate and rod structure 600 may be incorporated into a sole structure. Structure 600 includes a first plate 650 having front portion in a forefoot and midfoot regions and an extension 672 in midfoot and rearfoot regions. A second plate 652 is located in the rearfoot region and is attached to extension 672. A third plate 653 is located under second plate 652.

Forward ends of linkage rods 680*a*-680*e* are respectively attached to the bottoms of plantar support elements 651*a*-651*e* of first plate 650. The forward ends of rods 680*a*-680*e* and plantar supports 651*a*-651 respectively correspond to first through fifth metatarsal regions of a wearer of a shoe that includes structure 600. The rear ends of linkage rods 680*a*-680*e* are attached to the bottom of third plate 653.

The top surfaces of first plate 650 and second plate 652 may be curved, arched, and/or otherwise contoured so as to comfortably support a wearer's foot. One or more edges of plate 652 may form a heel cup. One or more edges of plate 650 may form a lateral or medial side support.

Structure 600 may be incorporated into a sole structure, in at least some embodiments, in a manner similar to that of the embodiment of FIGS. 2A-2C. A forefoot bladder, a forefoot midsole component and a forefoot outsole component may be attached to the bottom of first plate 650. A first rearfoot midsole component may be attached between plates 652 and 653 and a second rearfoot midsole component may be attached to the bottom of the second rearfoot midsole component. A rearfoot bladder may be contained in the first or second rearfoot midsole component. A sole structure incorporating structure 600 may then be attached to an upper.

Figure 7:
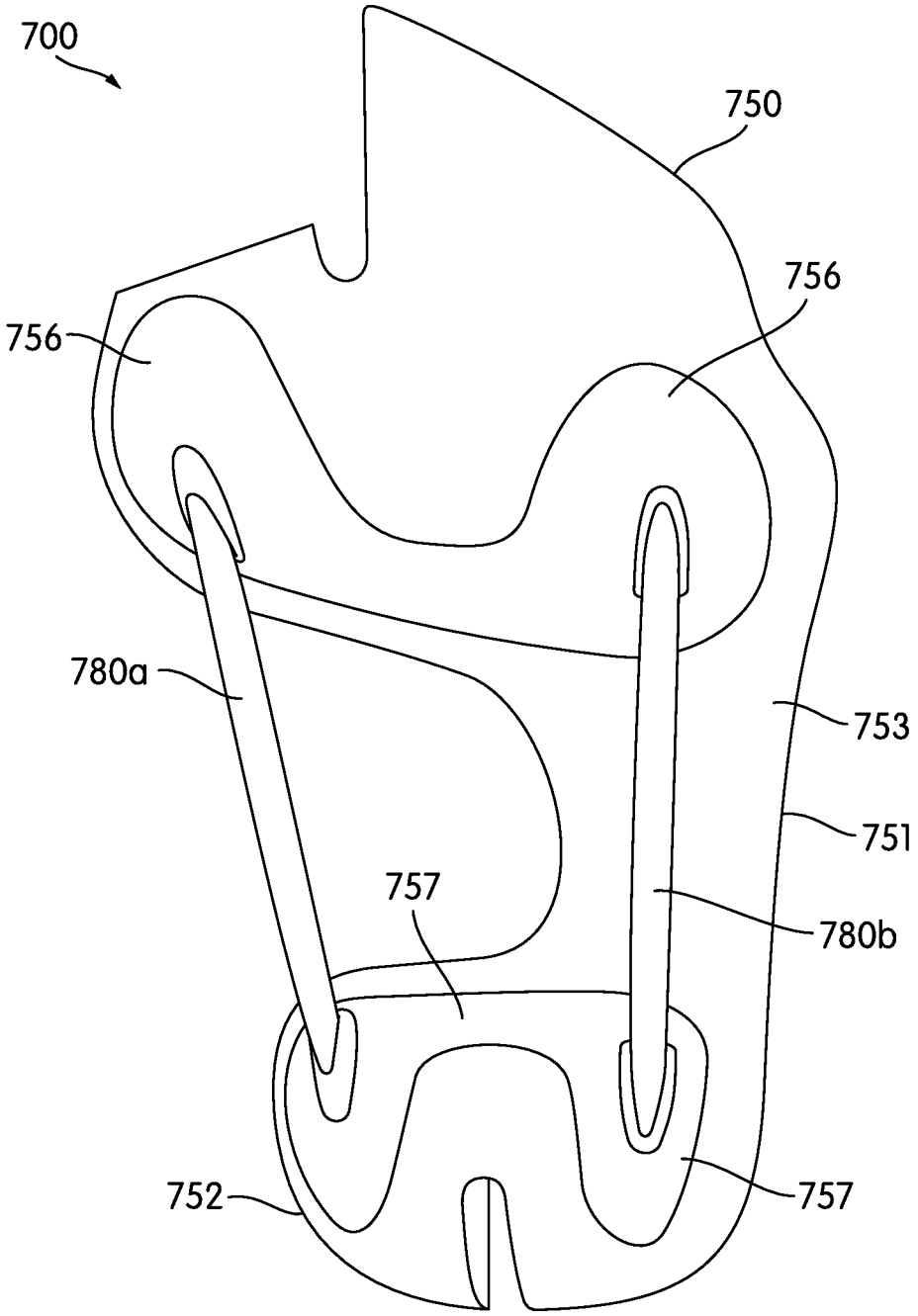

FIG. 7 is a bottom view of a plate and rod structure 700 according to another embodiment. A small portion of the frontmost end of structure 700 is not shown in FIG. 7. Plate and rod structure 700 may be incorporated into a sole structure. Structure 700 includes a single plate 751 having a front portion 750 located in a forefoot region, a rear portion 752 located in a rearfoot region, and a connecting portion 753 connecting portions 750 and 752. Structure 700 further includes a medial side linkage rod 780*a* and a lateral side linkage rod 780*b*. The front ends of rods 780*a* and 780*b* are joined by an integral forefoot reinforcement 756. The rear ends of rods 780*a* and 780*b* are joined by an integral rearfoot reinforcement 757. The top of forefoot reinforcement 756 is bonded to the bottom of front portion 750 and the top of rearfoot reinforcement 757 is bonded to the bottom of rear portion 752. The top of lateral rod 780*b* is bonded to the bottom of connecting portion 753.

The top surface of plate 751 may be curved, arched, and/or otherwise contoured so as to comfortably support a wearer's foot. One or more edges of rear portion 752 may form a heel cup. One or more edges of front portion 750 and/or connecting portion 753 may form a side support. Structure 700 may be incorporated into a sole structure, in at least some embodiments, by attaching a midsole to the top of plate 751. One or more bladders (e.g., in the forefoot and/or midfoot region) may be included in that midsole. Additionally or alternatively, one or more midsole components and bladders may be attached to the bottom of structure 700. One or more outsole members may be attached to the additional/alternative midsole(s) or to the bottom of structure 700. A sole structure incorporating structure 700 may then be attached to an upper.

Figure 8:
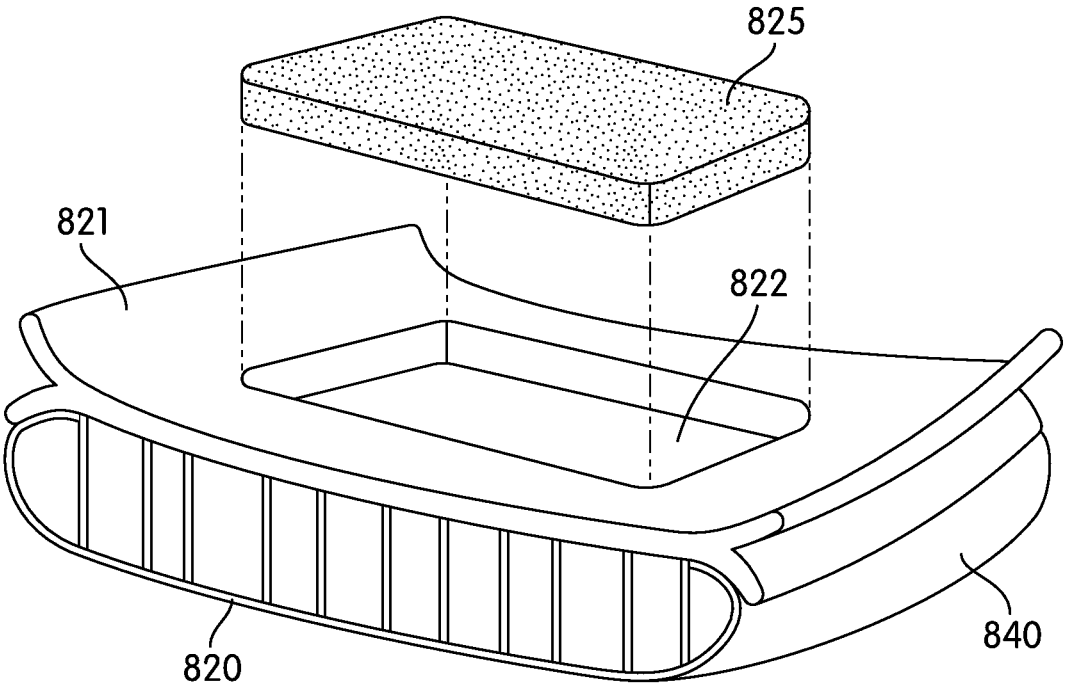
FIG. 8 is a top perspective view of a sole structure segment according to some additional embodiments.

FIG. 8 shows a segment 840 of a midsole similar to that which may be used in connection with structure 700 or in connection with structures described below in connection with FIGS. 9 through 11. Segment 840 includes a bottom surface 820 shaped to conform to a portion of plate 751 or to a portion of another plate and rod structure. A top surface 821 is shaped to conform to a bottom of an upper. Surface 821 includes a pocket 822 to hold a bladder 825.

Figure 9:
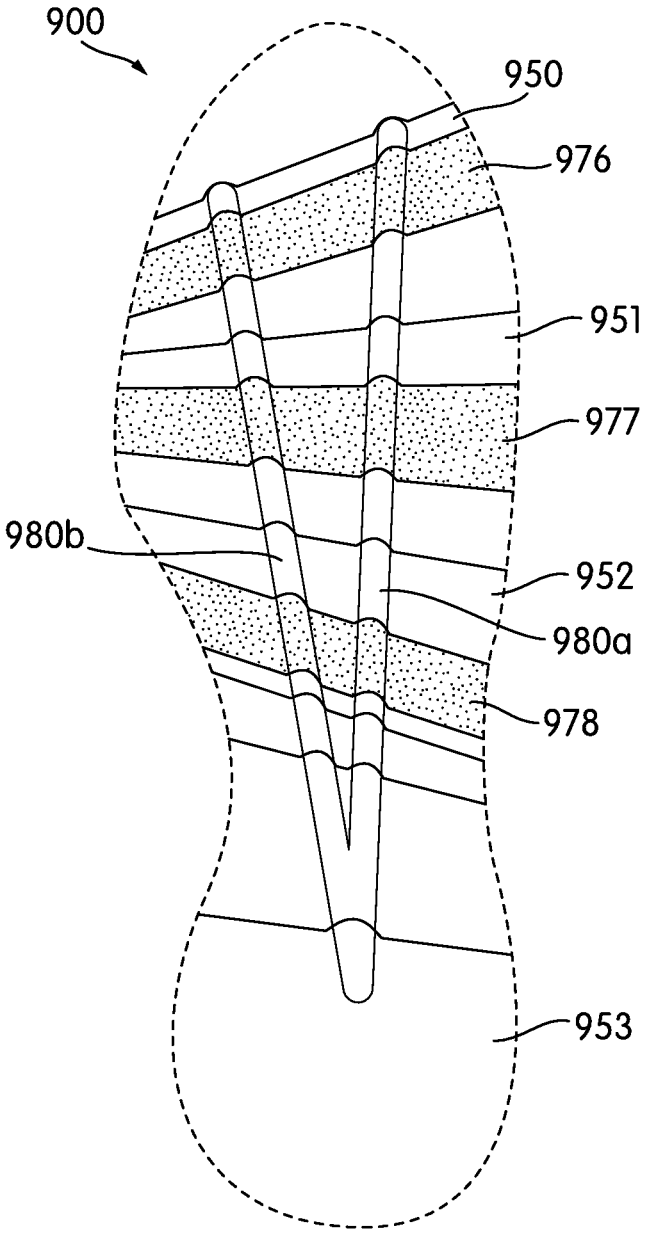
FIGS. 9 through 11 are top views of sole structures according to further additional embodiments

FIG. 9 is a partially schematic bottom view of a plate and rod structure 900 according to some embodiments. Structure 900 includes four separate plates 950 through 953. A first plate 950 is located in a forefoot region approximately corresponding to the proximal and distal phalanges (toes). A second plate 951 is also located in the forefoot region and extends from a region approximately corresponding to the metatarsal-phalangeal joints to a region approximately corresponding to the metatarsal heads. A third plate 952 is located in a midfoot region and extends from a region approximately corresponding to the metatarsal heads to the arch region. A fourth plate 953 is located in a heel region.

Linkage rods 980*a* (medial) and 980*b* (lateral) connect plates 950-953. The rear ends of rods 980*a* and 980*b* are joined to the bottom of plate 953. Rods 980*a* and 980*b* are joined to the bottom of plate 952 by a reinforcement 978, to the bottom of plate 951 by a reinforcement 977 and to the bottom of plate 950 by a reinforcement 976. Any or all of reinforcements 976-978 may be integral to rods 980*a* and/or 980*b*. Alternatively, one or more of reinforcements 976-978 may be separately formed from a material similar to that used for rods 980*a* and 980*b* (e.g., a carbon fiber composite).

The top surfaces of plates 950-953 may be curved, arched, and/or otherwise contoured so as to comfortably support a wearer's foot. One or more edges of plate 953 may form a heel cup. One or more edges of plates 950-952 may form a lateral or medial side support. Structure 900 may be incorporated into a sole structure, in at least some embodiments, by attaching a one or more midsole components to the tops of plates 950-953. Some or all of the midsole components may contain bladders. In some embodiments, a separate midsole component similar to segment 840 is attached to the top of each of plates 950-951. Each of those midsole components may include a bladder. Alternatively, only some of those midsole components may include a bladder (e.g., a rearfoot midsole component attached to plate 953 and a forefoot midsole components attached to plate 951). In some embodiments, a rearfoot midsole component may be attached to plate 953 and a single mid/forefoot midsole component attached to plates 950-952, with bladders contained in one or more of those midsole components.

Additionally or alternatively, one or more midsole components (with or without bladders) may be attached to the bottom of structure 900. One or more outsole members may be attached to the additional/alternative midsole(s) or to directly to the bottom of structure 900. A sole structure incorporating structure 900 may then be attached to an upper.

Figure 10:
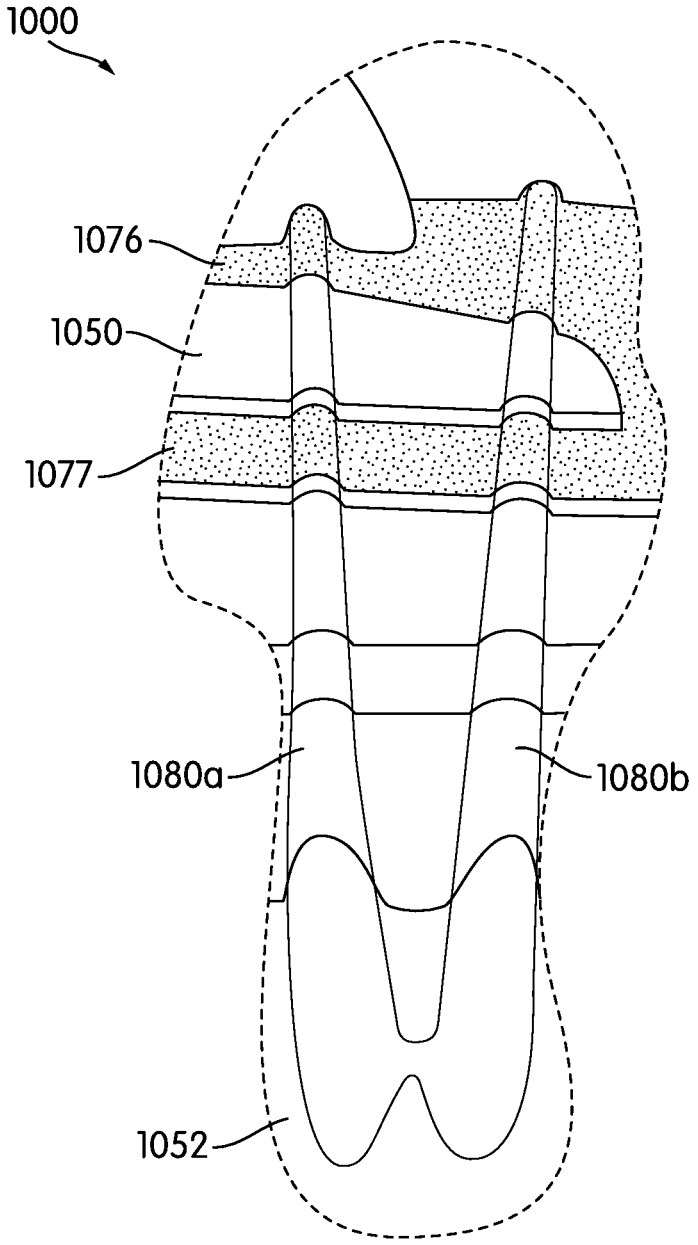

FIG. 10 is a partially schematic bottom view of a plate and rod structure 1000 according to some embodiments. Structure 1000 includes a first plate 1050 (located in forefoot and midfoot regions) and a second plate 1052 (located in a rearfoot region). Linkage rods 1080*a* (medial) and 1080*b* (lateral) connect plates 1050 and 1052. The rear ends of rods 1080*a* and 1080*b* are joined to the bottom of plate 1052. Rods 1080*a* and 1080*b* are joined to the bottom of plate 1050 by reinforcements 1076 and 1077. Either or both of reinforcements 1076 and 1077 may be integral to rods 1080*a* and/or 1080*b*. Alternatively, one or more of reinforcements 1076 and 1077 may be separately formed from a material similar to that used for rods 1080*a* and 1080*b* (e.g., a carbon fiber composite).

Top surfaces of plates 1050 and 1052 may be curved, arched, and/or otherwise contoured so as to comfortably support a wearer's foot. One or more edges of plate 1052 may form a heel cup. One or more edges of plate 1050 may form a lateral or medial side support. Structure 1000 may be incorporated into a sole structure, in at least some embodiments, by attaching separate midsole components to the tops of plates 1050 and 1052. Some or all of those midsole components may contain bladders. Additionally or alternatively, one or more midsole components (with or without bladders) may be attached to the bottom of structure 1000. One or more outsole members may be attached to the additional/alternative midsole(s) or to directly to the bottom of structure 1000. A sole structure incorporating structure 1000 may then be attached to an upper.

Figure 11:
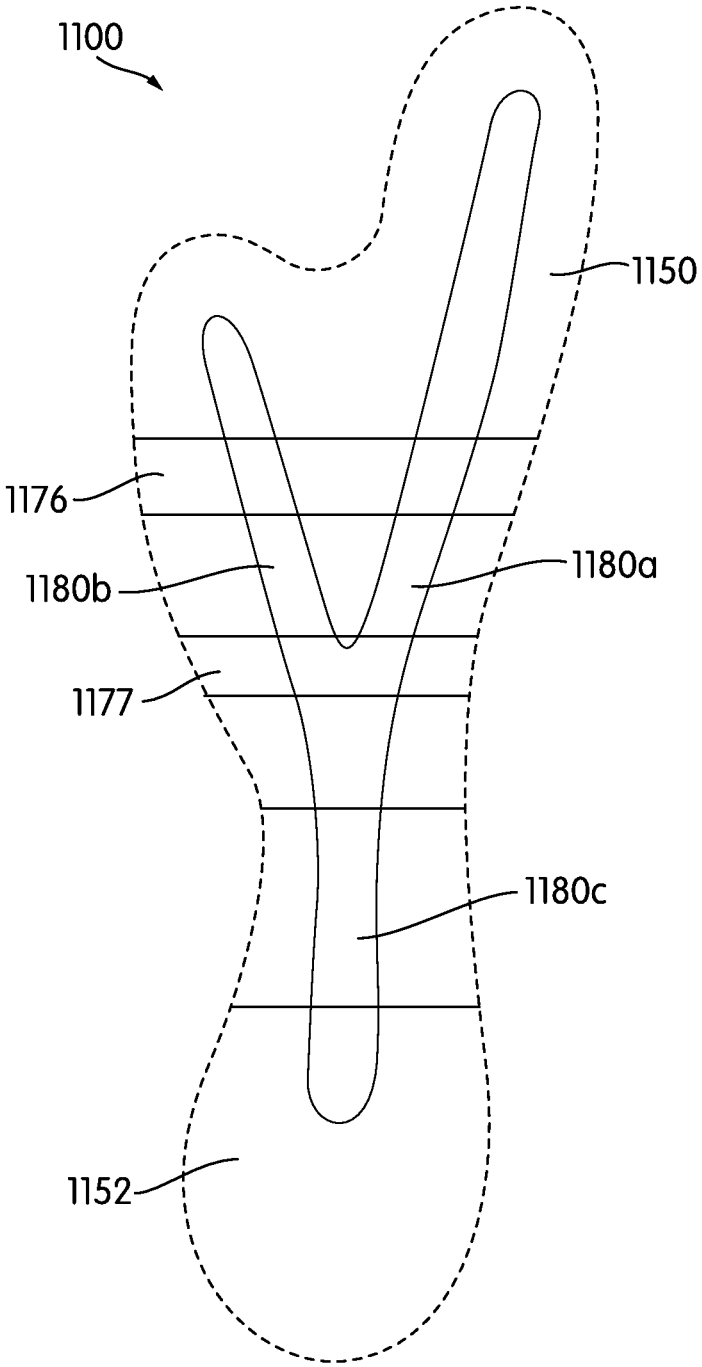

FIG. 11 is a partially schematic bottom view of a plate and rod structure 1100 according to some embodiments. Structure 1100 includes a first plate 1150 (located in forefoot and midfoot regions) and a second plate 1152 (located in a rearfoot region). A Y-shaped linkage rod 1180 includes a medial section 1180*a*, a lateral section 1180*b* and a mid/rearfoot section 1180*c*. The rear end of rod section 1180*c* is joined to the bottom of plate 1152. A forward section of rod 1180*c* (just behind the branch of sections 1180*a* and 1180*b*) is joined to the bottom of 1150 by a reinforcement 1177. Rods 1180*a* and 1180*b* are joined to the bottom of plate 1150 by a reinforcement 1176. Either or both of reinforcements 1176 and 1177 may be integral to rod 1180. Alternatively, one or more of reinforcements 1176 and 1177 may be separately formed from a material similar to that used for rod 1180 (e.g., a carbon fiber composite).

Top surfaces of plates 1150 and 1152 may be curved, arched, and/or otherwise contoured so as to comfortably support a wearer's foot. One or more edges of plate 1152 may form a heel cup. One or more edges of plate 1150 may form a lateral or medial side support. Structure 1100 may be incorporated into a sole structure, in at least some embodiments, by attaching separate midsole components to the tops of plates 1150 and 1152. Some or all of those midsole components may contain bladders. Additionally or alternatively, one or more midsole components (with or without bladders) may be attached to the bottom of structure 1100. One or more outsole members may be attached to the additional/alternative midsole(s) or to directly to the bottom of structure 1100. A sole structure incorporating structure 1100 may then be attached to an upper.

Figure 12:
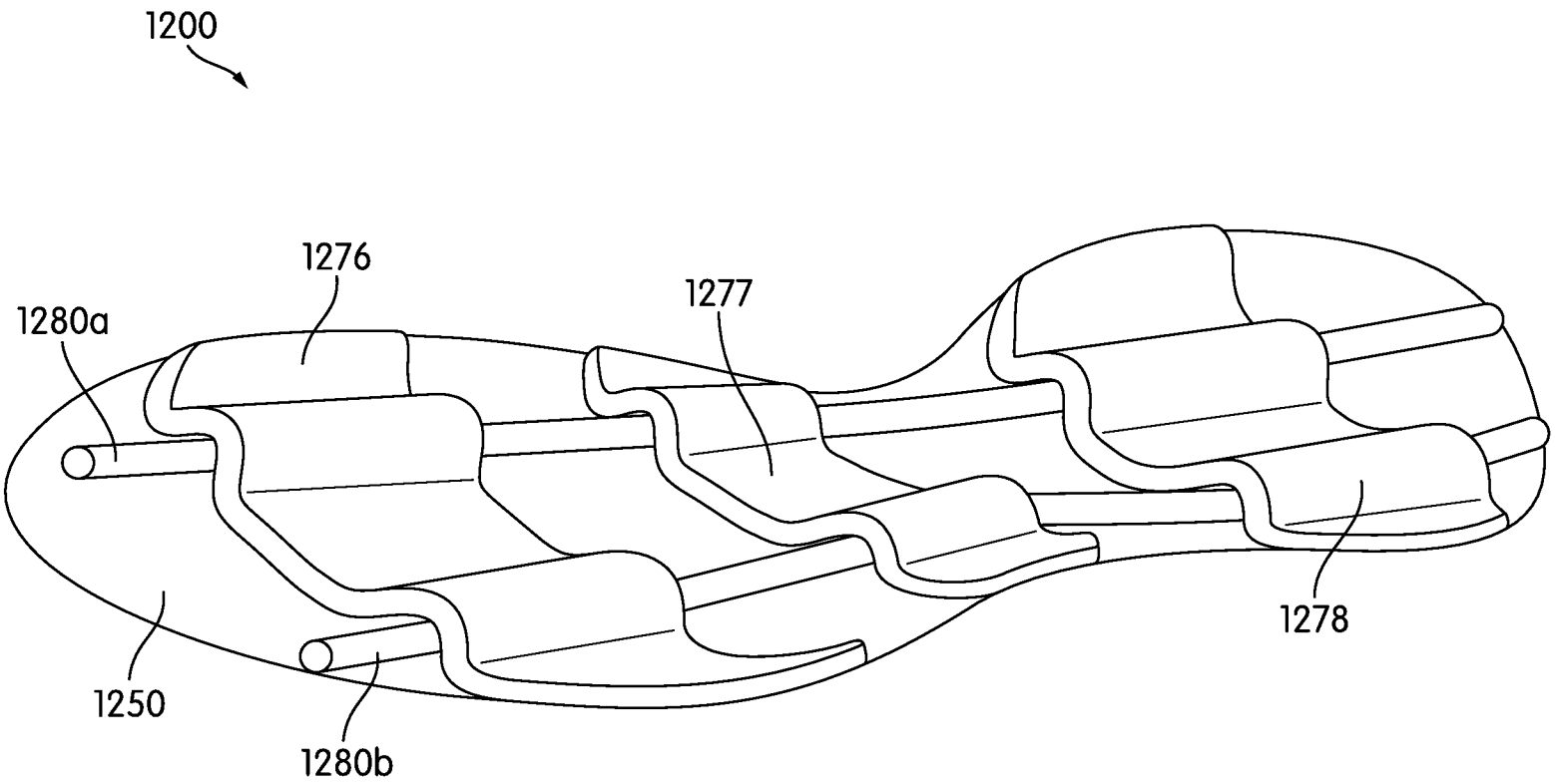
FIG. 12 is a top right perspective view of a plate and linkage structure according to certain additional embodiments.

In some embodiments, linkage rods may be attached to the top of a plate. FIG. 12 shows a plate and rod structure 1200 according to one such embodiment. In the embodiment of FIG. 12, rods 1280*a* and 1280*b* are attached to the top of plate 1250 by reinforcements 1276-1278. Any of reinforcements 1276-1278 may be integral to rods 1280*a* and 1280*b*. Alternatively, one or more of reinforcements 1276-1278 may be separately formed from a material similar to that used for rods 1280*a* and 1280*b* (e.g., a carbon fiber composite). Top surfaces of plate 1250 may be curved, arched, and/or otherwise contoured so as to comfortably support a wearer's foot, to form a heel cup and/or to form a lateral and/or medial side support. Structure 1200 may be incorporated into a sole structure, in at least some embodiments, by attaching one or more midsole components to the top of plate 1250, which midsole(s) may include one or more bladders. Additionally or alternatively, one or more midsole components (with or without bladders) may be attached to the bottom of plate 1250. One or more outsole members may be attached to the additional/alternative midsole(s) or to directly to the bottom of plate 1250. A sole structure incorporating structure 1200 may then be attached to an upper.

Figure 13:
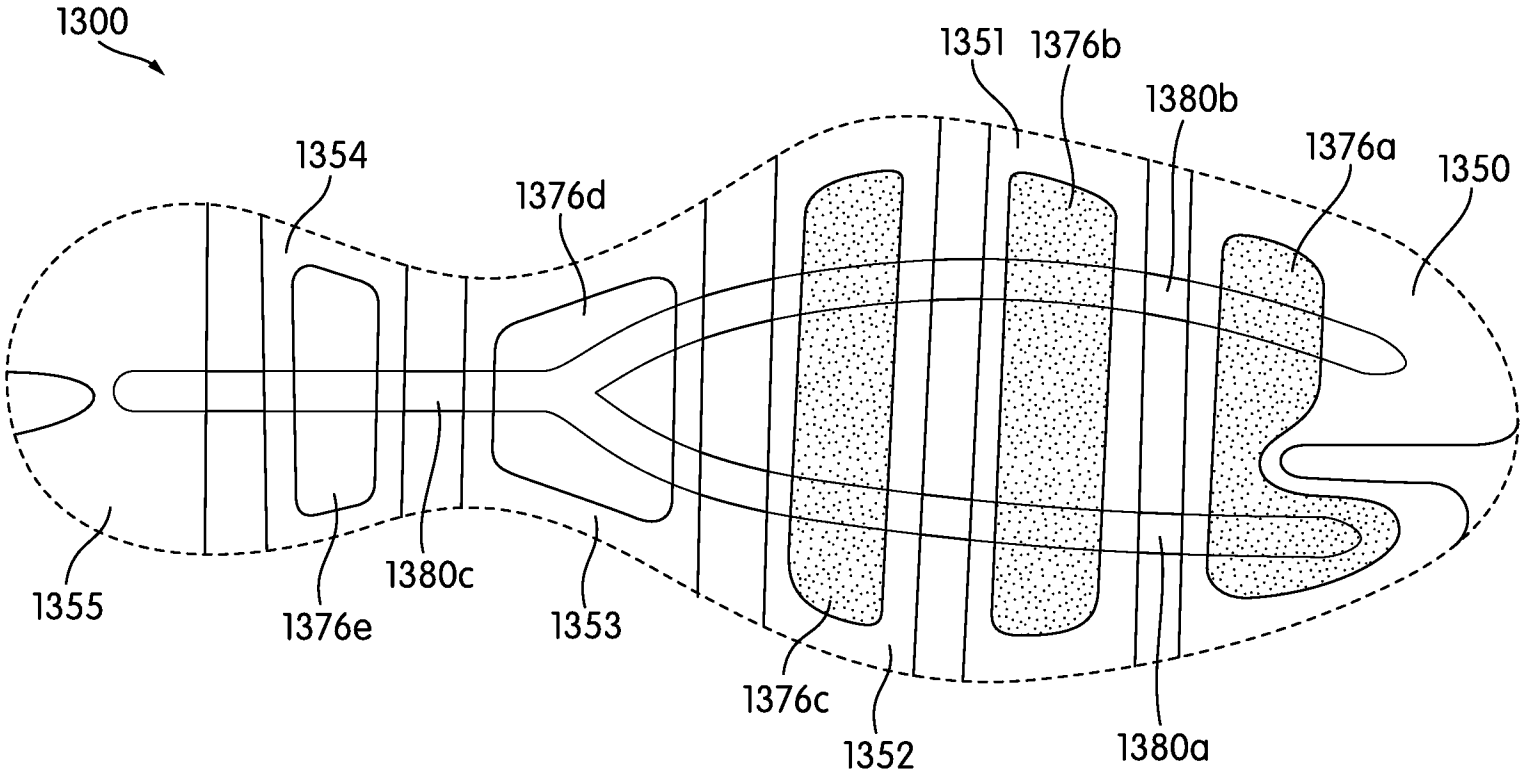
FIG. 13 is a bottom view of a sole structure according to some embodiments.

FIG. 13 is a bottom view of a plate and rod structure 1300 according to another embodiment. Structure 1300 includes six separate plates 1350 through 1355. A first plate 1350 is located in a forefoot toe region. A second plate 1351 is also located in a forefoot region approximately corresponding to the metatarsal distal ends. A third plate 1352 is located in a mid/forefoot region approximately corresponding to the metatarsal heads. A fourth plate 1353 is located in an arch region. A fifth plate 1354 is located in a front heel region. A sixth plate 1355 is located in a rear heel region.

A Y-shaped linkage rod unit 1380 includes a medial section 1380*a*, a lateral section 1380*b* and a mid/rearfoot section 1380*c*. The rear end of rod section 1380*c* is joined to the bottom of plate 1355. Rod 1380 is joined to the bottoms of plates 1350-1354 by reinforcements 1376*a*-1376*e*. Any of reinforcements 1376*a*-1376*e* may be integral to rod 1380. Alternatively, one or more of reinforcements 1376*a*-1376*e* may be separately formed from a material similar to that used for rod 1380 (e.g., a carbon fiber composite). Structure 1300 may be incorporated into a sole structure by attaching midsole elements (with or without bladders) to the tops and/or bottoms of plates 1250-1354.

Figure 14A:
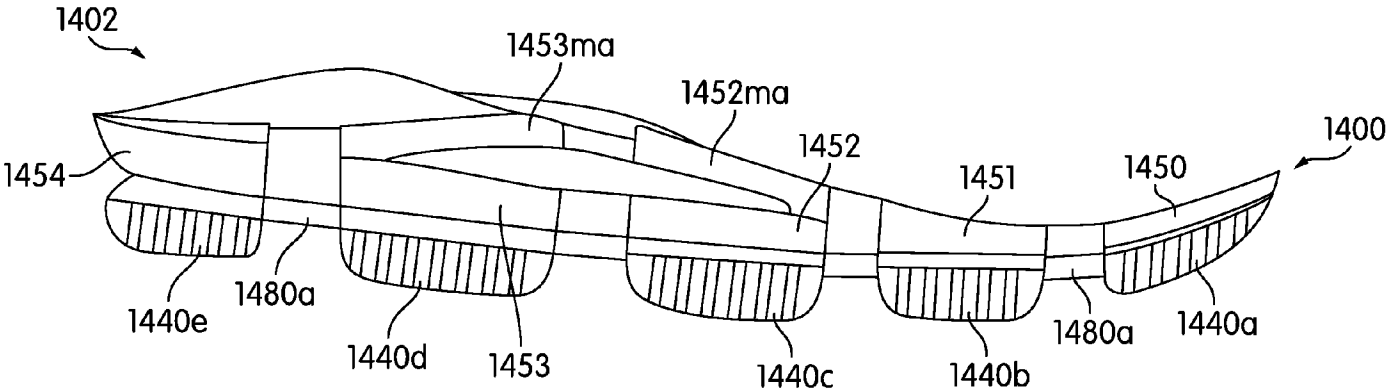
FIG. 14A is a side view of a sole structure formed according to some embodiments.
Figure 14C:
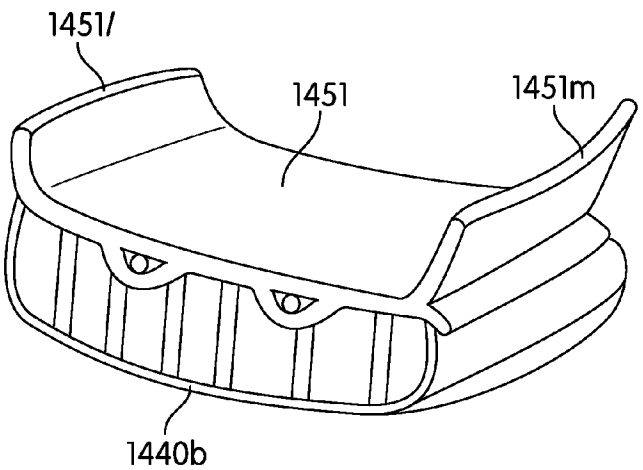
FIGS. 14B and 14C are perspective views of segments of the sole structure of FIG. 14A.
Figure 14B:
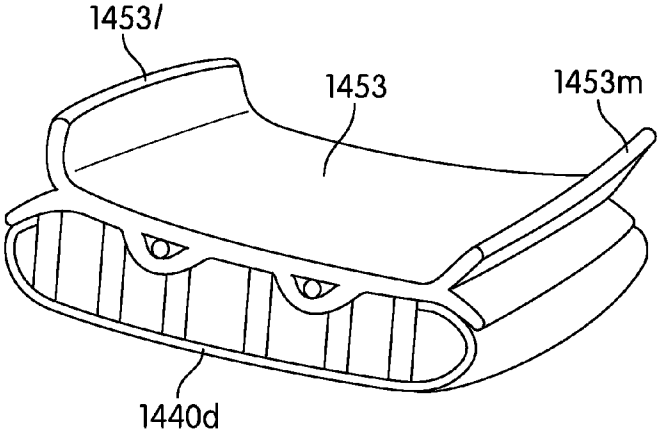

FIGS. 14A through 14C show another embodiment, similar to that of FIG. 13, in which separate midsole elements may be attached to the bottom of each of multiple plates. FIG. 14A is a medial side view of a sole structure 1402. FIGS. 14B and 14C are rear perspective views of segments of sole structure 1402.

Sole structure 1402 incorporates a plate and rod structure 1400 similar to structure 1300. Structure 1400 differs from structure 1300 by having five plates 1450-1454 instead of six plates 1350-1355. Structure 1400 further differs from structure 1300 by having a medial linkage rod 1480*a* and a separate lateral linkage rod (not shown) instead of a single Y-shaped linkage rod. The linkage rods of sole structure 1402 are attached to the bottoms of plates 1450-1454 by reinforcements such as reinforcement 1477 (FIG. 14B) and reinforcement 1466 (FIG. 14C).

In the embodiment of sole structure 1402, midsole element 1440*a* is attached to the bottom of plate 1450, midsole element 1440*b* is attached to the bottom of plate 1451, midsole element 1440*c* is attached to the bottom of plate 1452, midsole element 1440*d* is attached to the bottom of plate 1453 and midsole element 1440*e* is attached to the bottom of plate 1454. Each of midsole elements 1440*a*-1440*e* may have a separate outsole component attached to its bottom surface. Some or all of midsole elements 1440*a* through 1440*e* may include a bladder element.

Top surfaces plates of 1450-1455 may be curved, arched, and/or otherwise contoured so as to comfortably support a wearer's foot. One or more edges of plates 1450-1455 may form a heel cup or other lateral or medial side support. For example, and as seen in FIG. 14B, plate 1453 includes an upwardly extending lateral edge 14531 and an upwardly extending medial edge 1453*m*. As another example, and as seen in FIG. 14C, plate 1451 includes an upwardly extending lateral edge 14511 and an upwardly extending medial edge 1451*m*. An arch support 1453*ma* may be included as part of plate 1453 (shown in FIG. 14A but not in FIG. 14B) and an arch support 1452*ma* may be included as part of plate 1452. In some embodiments, arch supports 1452*ma* and 1453*ma* may be joined to form a single arch support that connects plates 1452 and 1453. Sole structure 1402 may be attached to an upper.

In each of the embodiments described above, one or more linkage rods provides propulsive recoil in a manner similar to that described in connection with sole structure 102 of FIGS. 1A-1C. Moreover, use of linkage rods in many embodiments partially decouples forefoot, midfoot and/or rearfoot portions of a sole structure along a longitudinal axis, thereby facilitating beneficial rotation of the forefoot and/or midfoot relative to the heel.

Additional embodiments include numerous variations on the location, number, shape, and orientation of linkage rods. In some embodiments, three, four or more linkage rods may be included in a sole structure. In some embodiments, and in additional to longitudinally oriented linkage rods as shown in various drawings, a sole structure may also or alternatively include transversely oriented linkage rods extending from the medial to lateral side. In some embodiments, linkage rods may be wholly or partially embedded in a midsole that extends the entire length of a sole structure. A midsole with embedded linkage rods may further include bladders located above or below the linkage rods. In some embodiments, a bladder may be located under one or more linkage rods in a forefoot and/or in a rearfoot region. In some embodiments, bladders may be located both above and under one or more linkage rods in a forefoot and/or in a rearfoot region.

Although various above-described embodiments include fluid filled bladders, some embodiments may lack a fluid filled bladder.

Any of numerous materials and/or material combinations can be used to form plates according to various embodiments. Such materials include, without limitation, plastics (e.g., thermoplastic polyurethane (TPU), polyurethane (PU), polyamides such as NYLON, acrylonitrile butadiene styrene (ABS), etc.), combinations of plastics, composites (e.g., glass, carbon and/or other fibers bound in epoxy, polyester or other type of polymer matrix), metals, metal/plastic combinations, etc. In at least some embodiments, plates are generally noncompressible.

Any of numerous materials and/or material combinations can similarly be used to form linkage rods and/or rod-connecting reinforcements according to various embodiments. Examples include, without limitation, the aforementioned plastics, composites, metals, etc. In some embodiments, one or more plates, reinforcements and/or linkage rods may be formed from the same material. Alternatively, different materials may be used for various components. In some embodiments, one or more plates, reinforcements and/or linkage rods may be integrally formed by molding as a single unit. Alternatively, components may be formed separately and glued, welded or otherwise bonded to one another.

As used herein, including the claims, "coupled" encompasses both direct and indirect attachment. For example, two coupled components could be directly attached to one another. As another example, two coupled components may be indirectly attached by attachment to one or more intermediate components.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from above-described embodiments are the within the scope of the invention. With regard to claims directed to an apparatus, an article of manufacture or some other physical component or combination of components, a reference in the claim to a potential or intended wearer or a user of a component does not require actual wearing or using of the component or the presence of the wearer or user as part of the claimed component or component combination.

The invention claimed is:

1. A sole structure, comprising:

a first plate forming a first portion and being located in a forefoot region of the sole structure, a second plate forming a second portion and being located in a rearfoot region of the sole structure, and an extension extending into the rearfoot region of the sole structure;

at least one compressible midsole component coupled to the first and second portions; and at least one linkage rod coupling the first and second portions, the at least one linkage rod configured to bias the first and second portions away from one another during bending of the sole structure that moves tops of the first and second portions toward one another.

2. The sole structure of claim 1, wherein the first and second plates are formed from a generally incompressible material.

3. The sole structure of claim 1, wherein the at least one linkage rod comprises a medial side rod and a lateral side rod.

4. The sole structure of claim 1, wherein the at least one compressible midsole component comprises a compressible foam and further comprises a fluid filled bladder.

5. The sole structure of claim 1, wherein the at least one compressible midsole component comprises a first midsole component coupled to the first portion and a separate second midsole component coupled to the second portion.

6. The sole structure of claim 5, wherein each of the first and second midsole components comprises a compressible foam and further comprises a fluid filled bladder.

7. The sole structure of claim 1, wherein the first portion comprises multiple separate forward-oriented plantar support elements separated by gaps.

8. The sole structure of claim 1, wherein a third portion connects the first and second portion.

9. The sole structure or claim 1, wherein the at least one compressible midsole component comprises a first midsole component coupled to a bottom of the first plate and a separate second midsole component coupled to a bottom of the second plate, and each of the first and second midsole components comprises a compressible foam and further comprises a fluid filled bladder.

10. The sole structure of claim 9, wherein the at least one linkage rod comprises a medial side rod and a lateral side rod.

11. The sole structure of claim 10, wherein the first plate comprises multiple separate forward-oriented plantar support elements separated by gaps.

12. An article of footwear comprising:

an upper; and the sole structure of claim 1 attached to the upper.

13. A sole structure, comprising:

separate first and second plates, the first plate located at least partially in a forefoot region of the sole structure and the second plate located at least partially in a rearfoot region of the sole structure;

a first compressible midsole component located at least partially in the forefoot region and coupled to the first plate;

a separate second compressible midsole component located at least partially in the rearfoot region and coupled to the second plate;

a linkage rod coupling the first and second plates, the linkage rod configured to bias the first and second plates to an unbent condition during bending of the sole structure; and a second linkage rod coupling the first and second plates.

14. The sole structure of claim 13, wherein the first and second plates are each formed from a material that is generally incompressible.

15. The sole structure of claim 13, wherein each of the first and second midsole components comprises a compressible foam and further comprises a fluid filled bladder.

16. The sole structure of claim 13, wherein the first plate comprises multiple separate forward-oriented plantar support elements separated by gaps.

17. The sole structure of claim 13, wherein the first plate further comprises an extension extending into the rearfoot region of the sole structure.

18. The sole structure of claim 13, wherein the first plate is located in the forefoot region and the second plate is located in the rearfoot region, and further comprising:

third and fourth plates located between the first and second plates, each of the third and fourth plates being separate from one another and from the first and second plates;

a third compressible midsole component coupled to the third plate; and a fourth compressible midsole component coupled to the fourth plate, wherein the linkage rod also couples the third and fourth plates to the first and second plates.

19. The sole structure of claim 13, further comprising a second linkage rod coupling the first and second plates, and wherein each of the first and second midsole components comprises a compressible foam and further comprises a fluid filled bladder.

20. An article of footwear comprising:

an upper; and the sole structure of claim 13 attached to the upper.

* * * * *